US012607375B2

(12) United States Patent
Li et al.

(10) Patent No.: US 12,607,375 B2
(45) Date of Patent: Apr. 21, 2026

(54) HUMIDIFIER WITH IMPROVED CONTROL AND FLOOR-STANDING FAN

(71) Applicant: Zhongshan Hongguan West Union Electric Technology Co., Ltd, Zhongshan (CN)

(72) Inventors: Yuying Li, Zhongshan (CN); Yubin Li, Zhongshan (CN)

(73) Assignee: Zhongshan Hongguan West Union Electric Technology Co., Ltd, Zhongshan (CN)

( * ) Notice: Subject to any disclaimer, the term of this patent is extended or adjusted under 35 U.S.C. 154(b) by 395 days.

(21) Appl. No.: 18/207,326

(22) Filed: Jun. 8, 2023

(65) Prior Publication Data

US 2024/0159408 A1 May 16, 2024

(30) Foreign Application Priority Data

Nov. 15, 2022 (CN) ..... 202211430073.5

(51) Int. Cl.

| | |
|---|---|
| ***F24F 11/00*** | (2018.01) |
| ***F24F 6/12*** | (2006.01) |
| ***F24F 11/70*** | (2018.01) |
| *F24F 6/00* | (2006.01) |

(52) U.S. Cl.

CPC ..... *F24F 11/0008* (2013.01); *F24F 6/12* (2013.01); *F24F 11/70* (2018.01); *F24F 2006/008* (2013.01)

(58) Field of Classification Search

CPC ..... F24F 11/0008; F24F 6/12; F24F 11/70; F24F 2006/008; F24F 7/007; F24F 11/30; F04D 25/08; F04D 29/705; Y02B 30/70

See application file for complete search history.

(56) References Cited

U.S. PATENT DOCUMENTS

2010/0225012 A1* 9/2010 Fitton ..... B05B 17/0615 261/28
2020/0368383 A1* 11/2020 Feng ..... A61M 11/005
2023/0314017 A1* 10/2023 Zhu ..... F24F 6/12 261/72.1

FOREIGN PATENT DOCUMENTS

CN 201874857 U * 6/2011
CN 215930031 U * 3/2022

* cited by examiner

*Primary Examiner* — Zhipeng Wang
(74) *Attorney, Agent, or Firm* — Birchwood IP

(57) ABSTRACT

A humidifier with improved control and a floor-standing fan, The humidifier includes a water tank, a base, an ultrasonic high-frequency atomizing plate, a float assembly, a drain valve and a control panel. The base is provided thereon with an atomizing chamber and an atomizing plate mounting base, the drain valve is arranged on a bottom plate of the water tank, the bottom plate of the atomizing chamber is provided with a support seat frame and a spring seat hole. The guide seat plate is fixed on the support seat frame, the magnet is pre-embedded in the floating block. A lower end of the spring is arranged in the spring seat hole. A top of the floating frame fits with the bottom plate of the water tank. When the water tank is separated from the base, the floating frame moves upward, the control panel controls the atomizing plate to stop operating, thereby eliminating safety hazards.

6 Claims, 7 Drawing Sheets

HUMIDIFIER WITH IMPROVED CONTROL AND FLOOR-STANDING FAN

CROSS-REFERENCE TO RELATED APPLICATIONS

This application claims the benefit and priority of Chinese patent application No. 202211430073.5, filed on Nov. 15, 2022, disclosure of which is hereby incorporated by reference in its entirety.

TECHNICAL FIELD

The present disclosure relates to a humidifier.

BACKGROUND

The prior art discloses a novel water drain control device for a humidifier, including a water drain structure, a support frame and a rotating shaft. The water drain structure is composed of a float, a valve rod, a spring and a water baffle. The water baffle, the valve rod and the spring are mounted on a bottom of a water tank. The spring is sleeved on the valve rod. A lower end of the valve rod abuts against a support rod end of the float, and an upper end of the valve rod is connected to the water baffle. The float, the support frame and the rotating shaft are mounted on a water chamber. The float is fixed on the support frame through the rotating shaft, and the float can swing up and down around the rotating shaft. However, the problem is that when the water tank is separated from a base, an atomizing plate is still working, resulting in safety hazards.

SUMMARY

It is an object of the present disclosure to provide a humidifier with improved control which is characterized in that an atomizing plate stops operating when a water tank is separated from a base.

The present disclosure is implemented as follows. A humidifier with improved control includes a water tank, a base, an ultrasonic high-frequency atomizing plate, a float assembly, a drain valve and a control panel, the base being provided thereon with an atomizing chamber having an upper opening and an atomizing plate mounting base arranged on a bottom plate of the atomizing chamber, the drain valve being arranged on a bottom plate of the water tank, and the water tank detachably fits with the atomizing chamber, wherein the bottom plate of the atomizing chamber is further provided with a support seat frame and a spring seat hole.

The humidifier further includes a guide seat plate, a floating frame, a float block, a magnet, a spring and a magnetic signal generator.

The guide seat plate is fixed on the support seat frame, the magnet is pre-embedded in the floating block, and the floating block is fixed in the floating frame. The floating frame slidably fits with a guide hole on the guide seat plate. A lower end of the spring is arranged in the spring seat hole while an upper end fits with a lower end of the floating frame. A top of the floating frame fits with the bottom plate of the water tank. The magnetic signal generator is arranged inside the atomizing chamber and fits with the magnet.

The humidifier with improved control is special in that the magnetic signal generator is a reed switch or a Hall sensor.

The humidifier with improved control is special in that the top of the floating frame is provided with a transmission rod, and the transmission rod fits with the bottom plate of the water tank.

The humidifier with improved control is special in that the drain valve includes a valve core, a valve rod, a pressure spring and a valve seat arranged on the bottom plate of the water tank, the valve seat includes a valve chamber having an upper opening and a water guide seat plate arranged on a lower part of the valve chamber, the water guide seat plate is formed thereon with a guide hole along an axial line and a water guide hole arranged surrounding the guide hole;

the valve rod passes through the pressure spring and the guide hole to connect to the valve core, and the valve core fits with an upper end of the valve chamber; and the float assembly drives the valve rod and the drain valve to turn on.

The humidifier with improved control is special in that the float assembly includes a seat body and a float;

the seat body is provided with a chamber body having an upper opening and a lateral opening, and a side wall plate at the lateral opening is formed with a half-shaft hole;

the float is provided with a rotating seat, and the rotating seat is provided with half-shafts on two sides thereof and a driving rod on a top thereof; and the rotating seat extends into the seat body through the lateral opening, the half-shaft rotatably fits with the half-shaft hole, and the driving rod fits with the valve rod.

A floor-standing fan includes a pedestal, a vertical pipe, a control box, a fan head and the humidifier as described above.

The base is provided with a vertical pipe seat, and the base extends toward the periphery in a circular direction to form a pedestal shell having a lower opening, and the pedestal is embedded into the pedestal shell.

A floor-standing fan includes a pedestal, a vertical pipe, a control box, a fan head, a mist guide pipe and the humidifier as described above. The control box includes a front box body having a rear opening and a rear box body having a front opening.

The front box body having an upper part formed with a front pipe outlet hole and a lower part formed with a front pipe inlet hole, the rear box body is formed with a recess having a rear opening, and the recess having a lower part formed with a rear pipe outlet hole and an upper part formed with a rear pipe inlet hole;

The mist guide pipe enters the control box through the front pipe inlet hole, enters the recess through the rear pipe outlet hole and is embedded into the recess, enters the control box through the rear pipe inlet hole and extends out of the control box through the front pipe outlet hole.

According to the humidifier with improved control of the present disclosure, when the water tank is separated from the base, the spring stretches, the floating frame moves upward, the magnet fits with the magnetic signal generator, and the control panel controls the atomizing plate to stop operating, thereby eliminating safety hazards.

DETAILED DESCRIPTION

A detailed description is provided below of embodiments of the present disclosure, examples of which embodiments are shown in the accompanying drawings on which the same or similar designator are used for representing the same or similar elements or the elements having the same or similar functions. Those embodiments described below with reference to the accompanying drawings are exemplary, which are merely to illustrate the present disclosure and cannot be understood as a restriction to the present disclosure.

Embodiment 1

Figure 1:
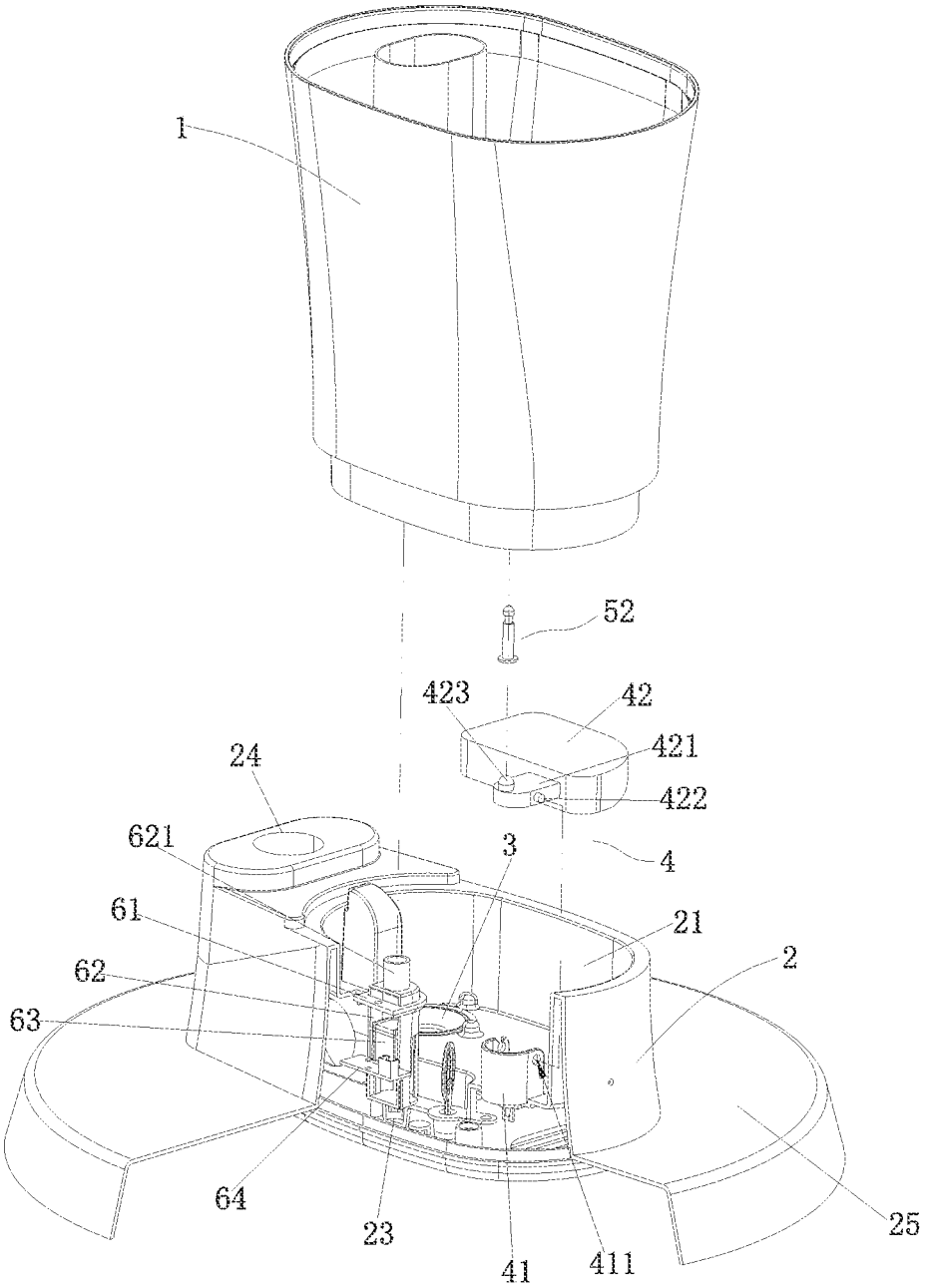
FIG. 1 is a first exploded perspective view according to the present disclosure.
Figure 2:
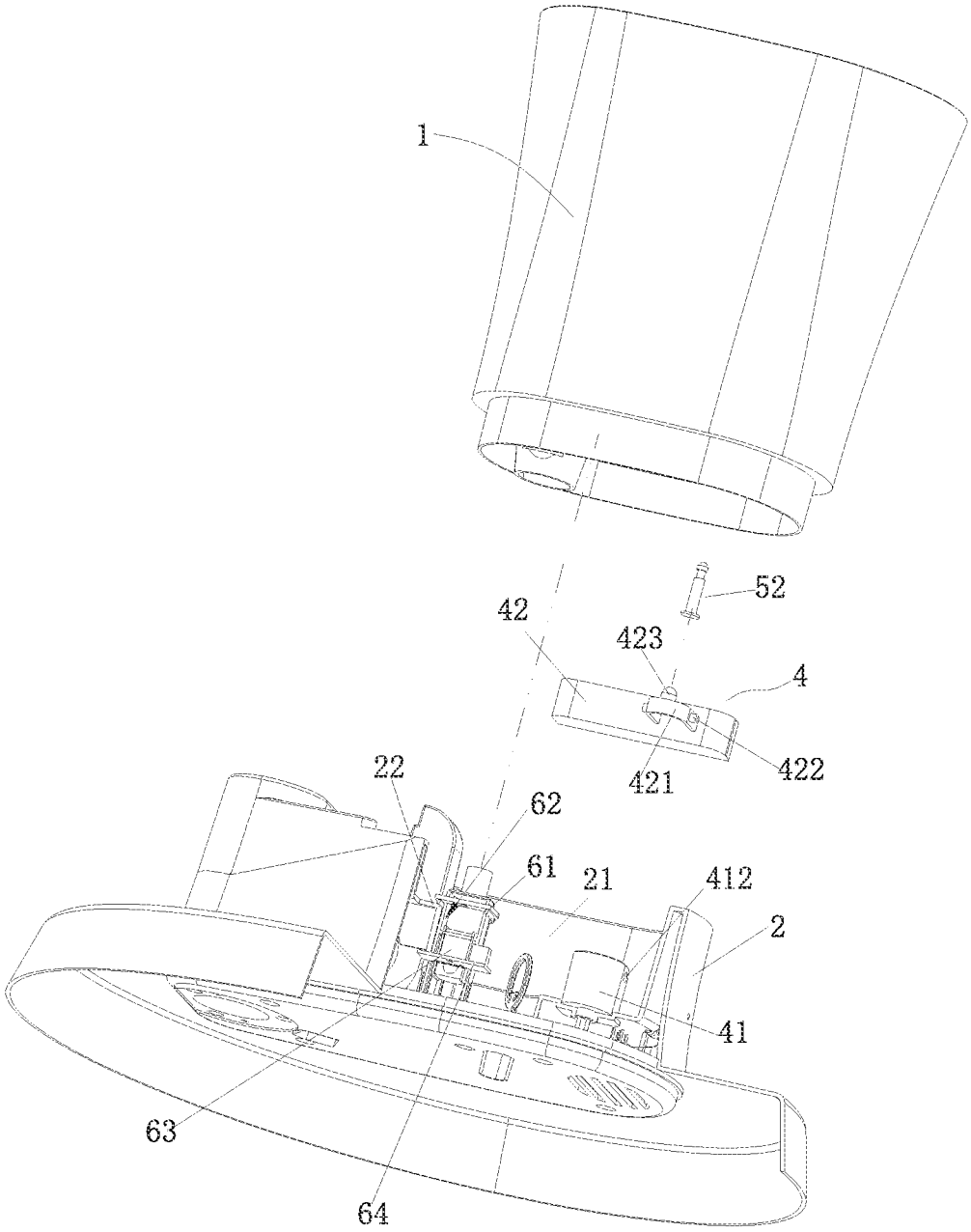
FIG. 2 is a second exploded perspective view according to the present disclosure.
Figure 3:
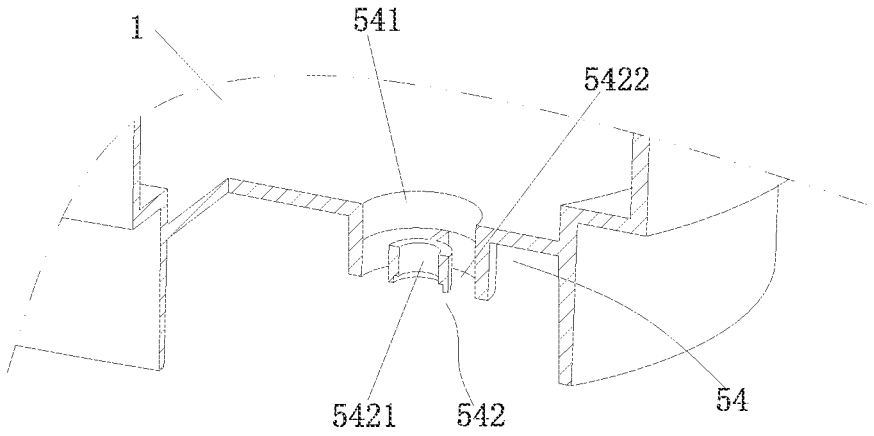
FIG. 3 is a sectional perspective view of a water tank according to the present disclosure.
Figure 4:
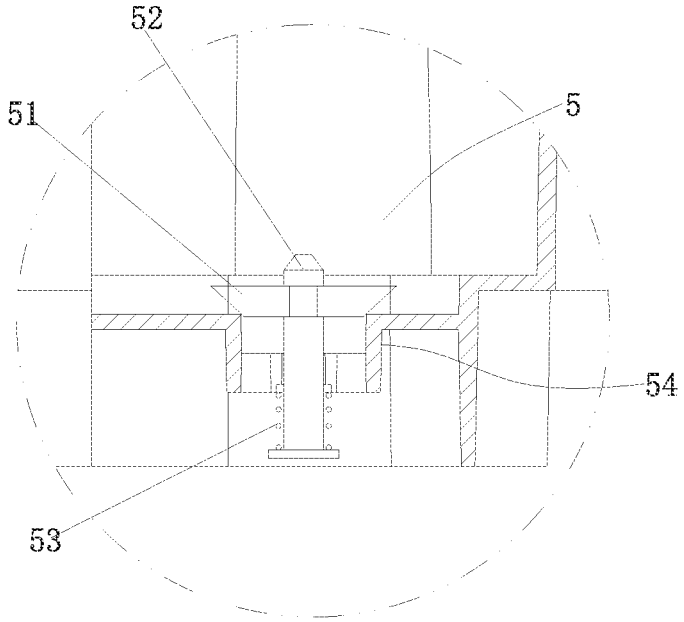
FIG. 4 is a sectional view of a water tank fitting with a drain valve according to the present disclosure.

As shown in FIG. 1, FIG. 2 and FIG. 4, a humidifier with improved control includes a water tank 1, a base 2, an ultrasonic high-frequency atomizing plate 3, a float assembly 4, a drain valve 5 and a control panel (not shown in figures). The base 2 is provided thereon with an atomizing chamber 21 having an upper opening and an atomizing plate mounting base (not shown in figures) arranged on a bottom plate of the atomizing chamber 21. The drain valve 5 is arranged on a bottom plate of the water tank 1, and the water tank 1 detachably fits with the atomizing chamber 21. The bottom plate of the atomizing chamber 21 is further provided with a support seat frame 22 and a spring seat hole 23.

The humidifier further includes a guide seat plate 61, a floating frame 62, a float block 63, a magnet (not shown in figures), a spring and a magnetic signal generator 64.

The guide seat plate 61 is fixed on the support seat frame, the magnet is pre-embedded in the floating block 63, and the floating block 63 is fixed in the floating frame 62. The floating frame 62 slidably fits with a guide hole on the guide seat plate 61 and move up and down, a lower end of the spring is arranged in the spring seat hole 23 while an upper end fits with a lower end of the floating frame 62. A top of the floating frame 62 fits with the bottom plate of the water tank 1, and the magnetic signal generator 64 is arranged inside the atomizing chamber 21 and fits with the magnet.

The magnetic signal generator 64 is a reed switch or a Hall sensor.

The top of the floating frame 62 is provided with a transmission rod 621, and the transmission rod 621 fits with the bottom plate of the water tank 1.

When the water tank 1 is fastened to the atomizing chamber 21 of the base 2, the bottom plate of the water tank 1 fits with the transmission rod 621, the spring is compressed, and the magnet is staggered from the magnetic signal generator 64. When the water tank is separated from the base, the floating frame 62 moves upward, the magnet is opposite to the magnetic signal generator 64, the magnetic signal generator 64 transmits a signal to the control panel, and the control panel powers off the ultrasonic high-frequency atomizing plate 3, whereby stopping operating. The safety is improved.

As shown in FIG. 4, the drain valve 5 includes a valve core 51, a valve rod 52, a pressure spring 53 and a valve seat 54 arranged on the bottom plate of the water tank 1.

The valve seat 54 includes a valve chamber 541 having an upper opening and a water guide seat plate 542 arranged on a lower part of the valve chamber, the water guide seat plate 542 is formed thereon with a guide hole 5421 along an axial line and a water guide hole 5422 arranged surrounding the guide hole.

The valve rod 52 passes through the pressure spring 53 and the guide hole 5421 to connect to the valve core 51, and the valve core 51 fits with an upper end of the valve chamber 541. The valve rod 52 has a lower end provided with a circular seat plate which supports the pressure spring 53.

The float assembly 4 drives the valve rod 52 and the drain valve 5 to turn on.

The float assembly 4 includes a seat body 41 and a float 42.

The seat body 41 is provided with a chamber body having an upper opening and a lateral opening, and a side wall plate at the lateral opening is formed with a half-shaft hole 411.

The float 42 is provided with a rotating seat 421, and the rotating seat is provided with half-shafts 422 on two sides thereof and a driving rod 423 on a top thereof.

The rotating seat 421 extends into the chamber body of the seat body 41 through the lateral opening, the half-shaft 422 rotatably fits with the half-shaft hole 411, and the driving rod 423 fits with the valve rod 52. When the water tank is fastened to the base 1, the driving rod 423 acts on the valve rod 52, the water inside the water tank enters the atomizing chamber 21 of the base. When the water tank is removed from the base, under the action of the pressure spring 53, the valve core 51 seals an upper end of the valve chamber 541.

Embodiment 2

Figure 5:
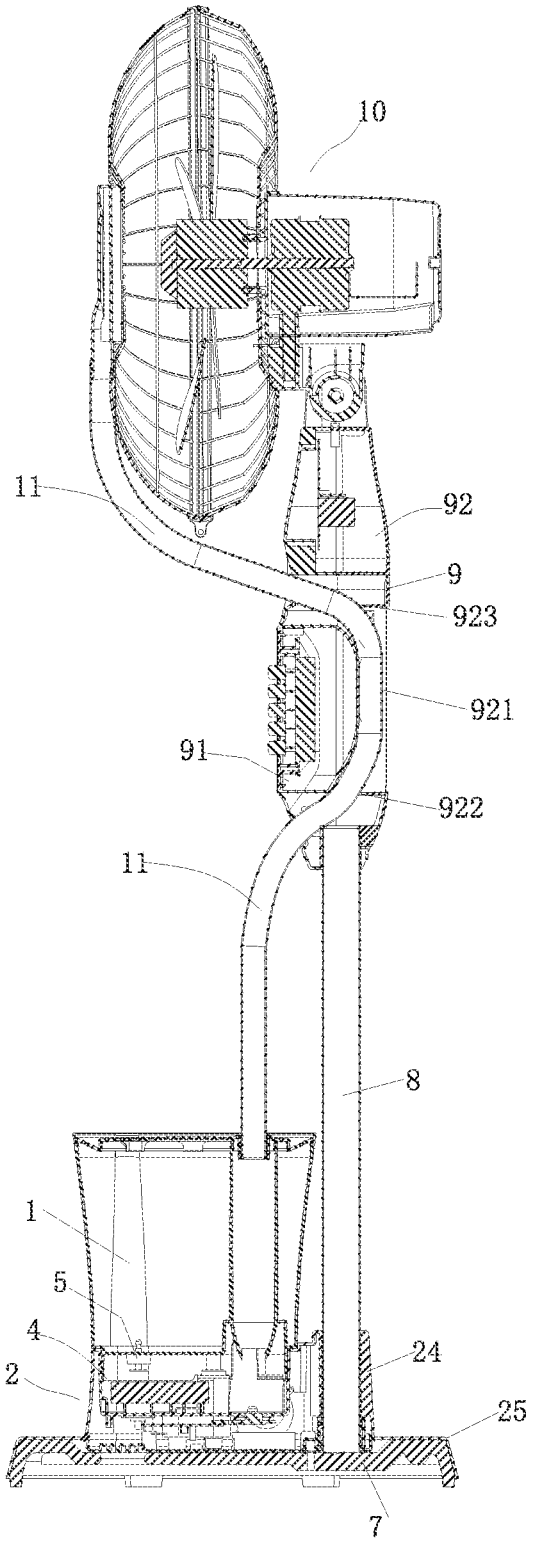
FIG. 5 is a sectional view of a floor-standing fan according to the present disclosure.
Figure 6:
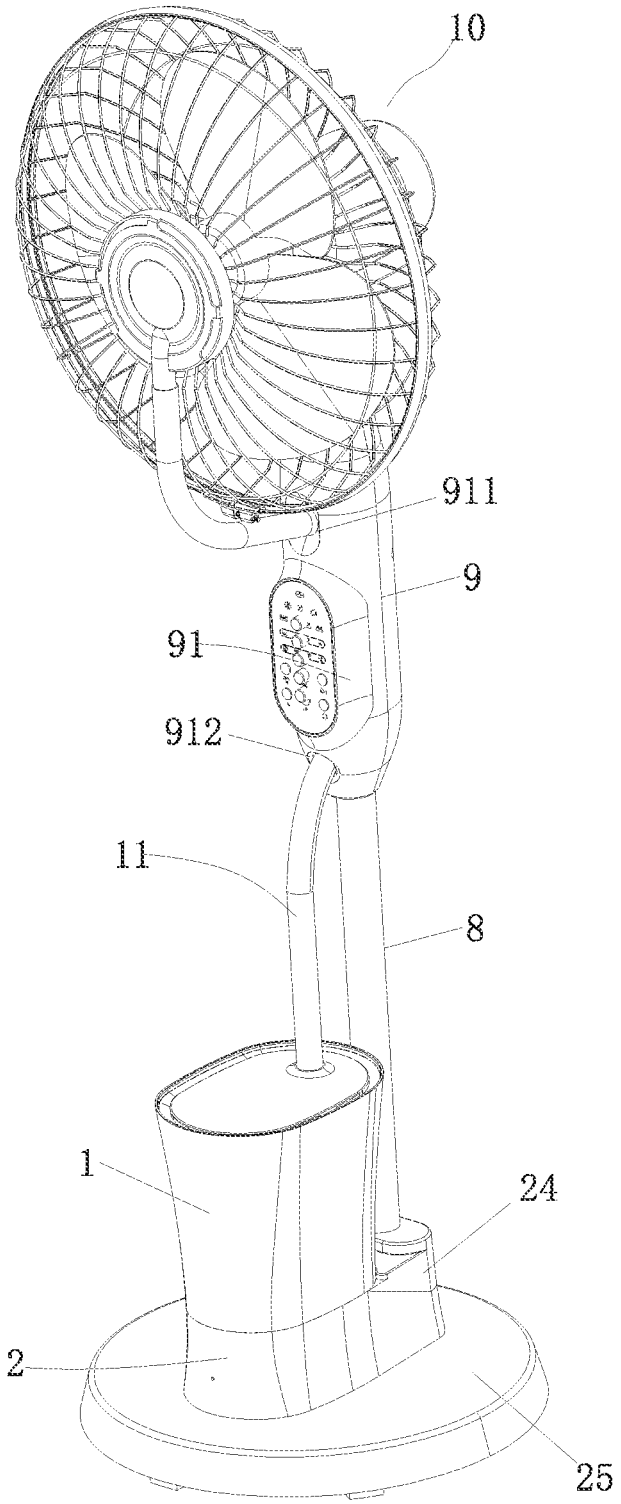
FIG. 6 is a perspective view of a floor-standing fan according to the present disclosure.
Figure 7:
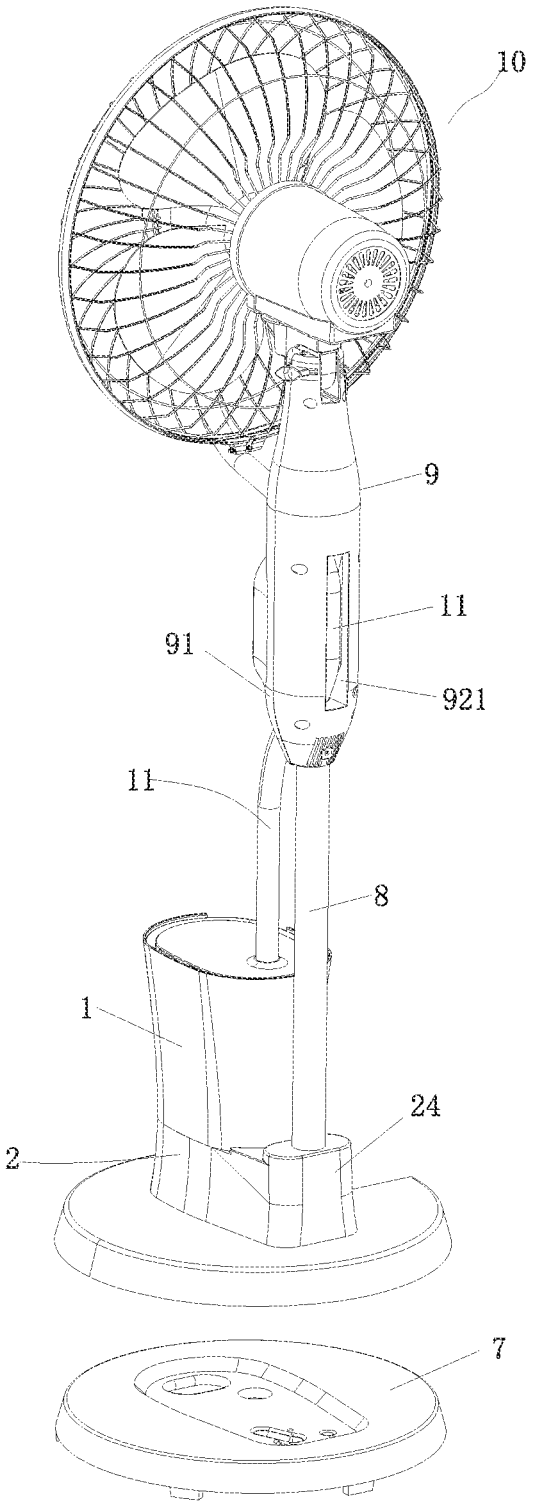
FIG. 7 is an exploded perspective view of a floor-standing fan according to the present disclosure.
Figure 8:
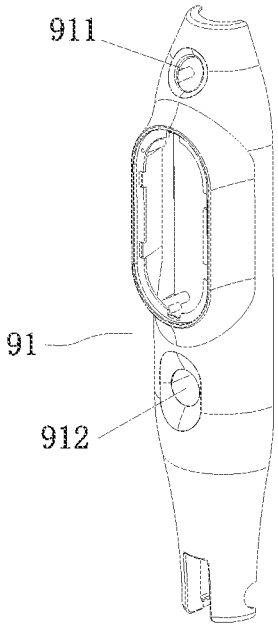
FIG. 8 is a perspective view of a front box body of a floor-standing fan according to the present disclosure.
Figure 9:
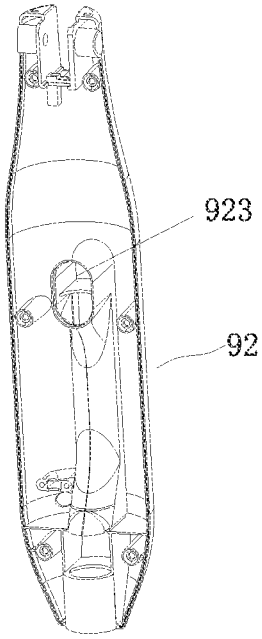
FIG. 9 is a first perspective view of a rear box body of a floor-standing fan according to the present disclosure.
Figure 10:
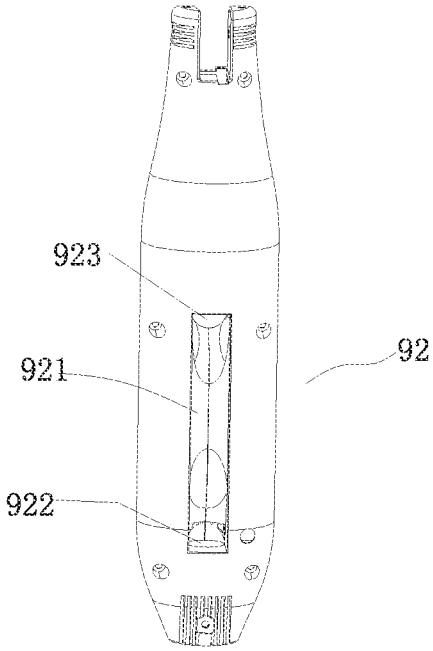
FIG. 10 is a second perspective view of a rear box body of a floor-standing fan according to the present disclosure.

As shown in FIG. 5, FIG. 6 and FIG. 7, a floor-standing fan includes a pedestal 7, a vertical pipe 8, a control box 9, a fan head 10, a mist guide pipe 11 and the humidifier as described above.

The base 2 is provided with a vertical pipe seat 24, and the base 2 extends toward the periphery in a circular direction to form a pedestal shell 25 having a lower opening, and the pedestal 7 is embedded into the pedestal shell 25. Position relationships and connection relationships of other components have been disclosed in the Chinese patent entitled Top-added-water floor-standing humidifying fan.

Embodiment 3

As shown in FIG. 5, FIG. 7, FIG. 8, FIG. 9 and FIG. 10, a floor-standing fan includes a pedestal 7, a vertical pipe 8, a control box 9, a fan head 10, a mist guide pipe 11 and the humidifier according to any one of claims 1 to 5. The control box 9 includes a front box body 91 having a rear opening and a rear box body 92 having a front opening.

The front box body 91 having an upper part formed with a front pipe outlet hole 911 and a lower part formed with a front pipe inlet hole 912, the rear box body 92 is formed with a recess 921 having a rear opening, and the recess having a lower part formed with a rear pipe outlet hole 922 and an upper part formed with a rear pipe inlet hole 923.

The mist guide pipe 11 enters the control box 9 through the front pipe inlet hole 912, enters the recess 921 through the rear pipe outlet hole 922 and is embedded into the recess 921, enters the control box 9 through the rear pipe inlet hole 923 and extends out of the control box 9 through the front pipe outlet hole 911, and then is connected to the fan head 10. With this structure, the length of the mist guide pipe 11 above or below the control box 9 can be adjusted.

Although the embodiments of the present disclosure are illustrated and described above, for the ordinary staff in this field, it is understandable that multiple changes, modifications, substitutions and variations may be made to these embodiments without departing from the principle and spirit of the present disclosure. The scope of the present disclosure is defined by the claims appended herein and equivalents thereof.

What is claimed is:

1. A humidifier with improved control, comprising: a water tank, a base, an ultrasonic high-frequency atomizing plate, a float assembly, a drain valve, a control panel, a guide seat plate, a floating frame, a float block, a magnet, a spring and a magnetic signal generator, wherein the base is provided thereon with an atomizing chamber having an upper opening and an atomizing plate mounting base arranged on a bottom plate of the atomizing chamber, the drain valve is arranged on a bottom plate of the water tank, and the water tank detachably fits with the atomizing chamber, wherein the bottom plate of the atomizing chamber is further provided with a support seat frame and a spring seat hole;

wherein the guide seat plate is fixed on the support seat frame, the magnet is pre-embedded in the floating block, the floating block is fixed in the floating frame, the floating frame slidably fits with a guide hole on the guide seat plate, a lower end of the spring is arranged in the spring seat hole while an upper end fits with a lower end of the floating frame, a top of the floating frame fits with the bottom plate of the water tank, and the magnetic signal generator is arranged inside the atomizing chamber and fits with the magnet;

wherein the float assembly comprises a seat body and a float;

wherein the drain valve comprises a valve core, a valve rod, a pressure spring and a valve seat arranged on the bottom plate of the water tank;

the seat body is provided with a chamber body having an upper opening and a lateral opening, and a side wall plate at the lateral opening is provided with a half-shaft hole;

the float is provided with a rotating seat, and the rotating seat is provided with half-shafts on two sides thereof and a driving rod on a top thereof; and the rotating seat extends into the seat body through the lateral opening, the half-shafts rotatably fit with the half-shaft hole, and the driving rod fits with the valve rod.

2. The humidifier with improved control according to claim 1, wherein the magnetic signal generator is a reed switch or a Hall sensor.

3. The humidifier with improved control according to claim 1, wherein the top of the floating frame is provided with a transmission rod, and the transmission rod fits with the bottom plate of the water tank.

4. The humidifier with improved control according to claim 1, wherein the valve seat comprises a valve chamber having an upper opening and a water guide seat plate arranged on a lower part of the valve chamber, the water guide seat plate is formed thereon with a guide hole along an axial line and a water guide hole arranged surrounding the guide hole;

the valve rod passes through the pressure spring and the guide hole to connect to the valve core, and the valve core fits with an upper end of the valve chamber; and the float assembly drives the valve rod and the drain valve to turn on.

5. A floor-standing fan, comprising a pedestal, a vertical pipe, a control box, a fan head, a mist guide pipe and a humidifier, wherein the humidifier comprises a water tank, a base, an ultrasonic high-frequency atomizing plate, a float assembly, a drain valve, a control panel, a guide seat plate, a floating frame, a float block, a magnet, a spring, and a magnetic signal generator, wherein the base is provided with an atomizing chamber having an upper opening and an atomizing plate mounting base arranged on a bottom plate of the atomizing chamber, the drain valve is arranged on a bottom plate of the water tank, and the water tank detachably fits with the atomizing chamber, wherein the bottom plate of the atomizing chamber is further provided with a support seat frame and a spring seat hole;

wherein the guide seat plate is fixed on the support seat frame, the magnet is pre-embedded in the floating block, the floating block is fixed in the floating frame, the floating frame slidably fits with a guide hole on the guide seat plate, a lower end of the spring is arranged in the spring seat hole and an upper end fits with a lower end of the floating frame, a top of the floating frame fits with the bottom plate of the water tank, and the magnetic signal generator is arranged inside the atomizing chamber and fits with the magnet;

wherein the float assembly comprises a seat body and a float;

wherein the drain valve comprises a valve core, a valve rod, a pressure spring and a valve seat arranged on the bottom plate of the water tank;

the seat body is provided with a chamber body having an upper opening and a lateral opening, and a side wall plate at the lateral opening is provided with a half-shaft hole;

the float is provided with a rotating seat, and the rotating seat is provided with half-shafts on two sides thereof and a driving rod on a top thereof; and the rotating seat extends into the seat body through the lateral opening, the half-shafts rotatably fit with the half-shaft hole, and the driving rod fits with the valve rod;

wherein the base is provided with a vertical pipe seat, and the base extends toward the periphery in a circular direction to form a pedestal shell having a lower opening, and the pedestal is embedded into the pedestal shell.

6. A floor-standing fan, comprising a pedestal, a vertical pipe, a control box, a fan head, a mist guide pipe and a humidifier, wherein the humidifier comprises a water tank, a base, an ultrasonic high-frequency atomizing plate, a float assembly, a drain valve, a control panel, a guide seat plate, a floating frame, a float block, a magnet, a spring, and a magnetic signal generator, wherein the base is provided with an atomizing chamber having an upper opening and an atomizing plate mounting base arranged on a bottom plate of the atomizing chamber, the drain valve is arranged on a bottom plate of the water tank, and the water tank detachably fits with the atomizing chamber, wherein the bottom plate of the atomizing chamber is further provided with a support seat frame and a spring seat hole;

wherein the guide seat plate is fixed on the support seat frame, the magnet is pre-embedded in the floating block, the floating block is fixed in the floating frame, the floating frame slidably fits with a guide hole on the guide seat plate, a lower end of the spring is arranged in the spring seat hole and an upper end fits with a lower end of the floating frame, a top of the floating frame fits with the bottom plate of the water tank, and the magnetic signal generator is arranged inside the atomizing chamber and fits with the magnet;

wherein the float assembly comprises a seat body and a float;

wherein the drain valve comprises a valve core, a valve rod, a pressure spring and a valve seat arranged on the bottom plate of the water tank;

the seat body is provided with a chamber body having an upper opening and a lateral opening, and a side wall plate at the lateral opening is provided with a half-shaft hole;

the float is provided with a rotating seat, and the rotating seat is provided with half-shafts on two sides thereof and a driving rod on a top thereof; and the rotating seat extends into the seat body through the lateral opening, the half-shafts rotatably fit with the half-shaft hole, and the driving rod fits with the valve rod;

wherein the control box comprises a front box body having a rear opening and a rear box body having a front opening;

the front box body has an upper part formed with a front pipe outlet hole and a lower part formed with a front pipe inlet hole, the rear box body is formed with a recess having a rear opening, and the recess has a lower part formed with a rear pipe outlet hole and an upper part formed with a rear pipe inlet hole;

the mist guide pipe enters the control box through the front pipe inlet hole, enters the recess through the rear pipe outlet hole and is embedded into the recess, enters the control box through the rear pipe inlet hole and extends out of the control box through the front pipe outlet hole.

* * * * *